US006488833B1

(12) United States Patent
Sakata et al.

(10) Patent No.: US 6,488,833 B1
(45) Date of Patent: Dec. 3, 2002

(54) METHOD FOR ELECTROLYSIS OF ALKALI CHLORIDE

(75) Inventors: Akihiro Sakata, Tokyo (JP); Koji Saiki, Osaka (JP); Takeshi Watanabe, Osaka (JP)

(73) Assignees: Toagosei Co., Ltd., Tokyo (JP); Kaneka Corporation, Osaka (JP); Mitsui Chemicals, Inc., Tokyo (JP)

( * ) Notice: Subject to any disclaimer, the term of this patent is extended or adjusted under 35 U.S.C. 154(b) by 0 days.

(21) Appl. No.: 09/786,711

(22) PCT Filed: Jul. 6, 2000

(86) PCT No.: PCT/JP00/04520

§ 371 (c)(1),
(2), (4) Date: Mar. 8, 2001

(87) PCT Pub. No.: WO01/04383

PCT Pub. Date: Jan. 18, 2001

(30) Foreign Application Priority Data

Jul. 9, 1999 (JP) ..... 11-196287

(51) Int. Cl.[7] ..... C25B 1/16
(52) U.S. Cl. ..... 205/515; 205/516
(58) Field of Search ..... 205/515, 516

(56) References Cited

U.S. PATENT DOCUMENTS 4,187,350 A * 2/1980 McIntyre et al. ..... 429/45
4,221,644 A * 9/1980 LaBarre ..... 205/515
4,486,276 A * 12/1984 Cohn et al. ..... 205/515
4,969,981 A * 11/1990 Rogers et al. ..... 205/466

FOREIGN PATENT DOCUMENTS

| | | |
|---|---|---|
| JP | 55-89486 | 7/1980 |
| JP | 1-234585 | 9/1989 |
| JP | 10-110287 | 4/1998 |

* cited by examiner

*Primary Examiner*—Arun S. Phasge
(74) *Attorney, Agent, or Firm*—Young & Thompson

(57) ABSTRACT

Provided is a process which permits, upon preparation of chlorine and a caustic alkali by electrolyzing an aqueous alkali chloride solution in an ion-exchange-membrane-method alkali chloride electrolytic cell equipped with a gas diffusion cathode, decrease of an excess ratio of an oxygen containing gas to be fed newly to the gas diffusion cathode and facilitates temperature control of the electrolytic cell. A process for electrolyzing an alkali chloride comprising: introducing saline water into an anode chamber of an ion-exchange-membrane-method alkali chloride electrolytic cell equipped with a gas diffusion cathode; and introducing an oxygen-containing gas into a gas chamber of a gas diffusion cathode, to thereby obtain chlorine in the anode chamber and an aqueous caustic alkali solution in the cathode chamber.

3 Claims, 3 Drawing Sheets

METHOD FOR ELECTROLYSIS OF ALKALI CHLORIDE

TECHNICAL FIELD

The present invention relates to an electrolytic process of an alkali chloride by the ion exchange membrane method using a gas diffusion cathode, particularly to a process for feeding an oxygen-containing gas and an aqueous alkali hydroxide solution or water in the electrolytic process of an alkali chloride by the ion exchange membrane method.

BACKGROUND ART

It is known to obtain a caustic alkali by electrolyzing an aqueous alkali chloride solution by the ion exchange membrane method using a gas diffusion cathode. In this process, roughly speaking, an anode chamber having an anode and containing an aqueous alkali chloride solution and a cathode chamber having a cathode and containing water or an aqueous caustic alkali solution are partitioned by an ion exchange membrane, usually a cationic exchange membrane. When electrolysis is effected by sending an electric current between both electrodes, a gas diffusion cathode which is made of, at a portion of the cathode, a porous substance and has, at its back, a gas chamber to be fed with an oxygen-containing gas is used, whereby the caustic alkali is formed in the cathode chamber. No hydrogen gas is generated at the cathode so that this process is accompanied with such an advantage as a marked reduction of an electrolytic voltage.

Examples of the patent literature which discloses such an electrolytic process include JP-A-54-97600 (the term "JP-A" as used herein means an "unexamined published Japanese patent application), JP-A-56-44784, JP-A-56-130482, JP-A-57-152479, JP-A-59-133386, JP-A-61-266591, JP-B-58-441156 (the term "JP-B" as used herein means an "examined published Japanese patent publication"), JP-B-58-49639, JP-B-60-9595 and JP-B-61-20634.

In addition, a number of proposals have been made on a production process of a gas diffusion cathode and improvement in the performance of it, but they hardly include a process for properly feeding an oxygen-containing gas.

In the conventionally known electrolysis of an alkali chloride by using the ion exchange membrane method without a gas diffusion cathode, an anode chamber having an anode is partitioned from a cathode chamber having a cathode by an ion exchange membrane. An aqueous alkali chloride solution is fed to the anode chamber for generating a chlorine gas at the anode, while a caustic alkali or water is fed to the cathode chamber for generating the caustic alkali and a hydrogen gas at the cathode.

Usually in the electrolysis of an alkali chloride in accordance with the ion exchange membrane method by using a gas diffusion cathode, on the other hand, an anode chamber having an anode is separated from a cathode chamber having a gas diffusion cathode by an ion exchange membrane. An aqueous alkali chloride solution is fed to the anode chamber for generating a chlorine gas at the anode. A caustic alkali or water is fed to the cathode chamber and an oxygen-containing gas is fed to the gas chamber of the gas diffusion cathode, whereby the caustic alkali is generated at the cathode.

The comparison of these two electrolytic processes indicates that they are utterly same in the reaction at an anode, but differ largely in the reaction at a cathode. The electrolysis by the ion exchange membrane method using a gas diffusion cathode is characterized in that no hydrogen gas is generated.

Various types of a gas diffusion cathode to be used for the latter process have been proposed. Examples include a microporous gas-permeable sheet obtained by hot pressing a mixture of carbon powders and polytetrafluoroethylene powders. It may hold thereon a catalyst, for example, a noble metal such as platinum or silver, or an alloy thereof or may be reinforced with a metal mesh for raising its strength or conductivity. This gas diffusion cathode is usually equipped with a gas chamber on the back side of the electrode surface. An oxygen-containing gas is fed to this gas chamber to cause the reaction which will be described later, whereby generation of a hydrogen gas on the electrode surface can be prevented.

In the electrolysis of an alkali chloride by using a gas diffusion cathode, appropriate supply of an oxygen-containing gas is very important. A gas containing oxygen in an amount exceeding the stoichiometric amount required for the reaction must be supplied. When an oxygen amount is insufficient, hydrogen is inevitably produced at the gas diffusion cathode. There is a danger of this hydrogen reacting with oxygen and causing explosion. In addition, the performance of the gas diffusion cathode drastically lowers at this time. So an oxygen-containing gas is usually fed in excess. Too much supply however leads to waste of the raw material. Although an appropriate excess ratio of oxygen to be fed varies depending on the properties of the gas diffusion cathode, a preferred excess ratio of oxygen relative to the stoichiometric amount is considered to be larger than a predetermined value. The extent of the excess ratio varies, depending on various conditions so it cannot be determined in a wholesale manner. The higher the oxygen concentration of the oxygen-containing gas, the better the performance of the gas diffusion cathode. In this case, the excess ratio is said to be set at not so high.

Air, which is most easily available and exists abundantly, as the oxygen-containing gas is inexpensive as a raw material gas, but use thereof deteriorates the oxygen reducing performance of the gas diffusion electrode owing to its low oxygen concentration. Use of pure oxygen on the other hand leads to a cost increase, though a gas diffusion electrode exhibits a sufficient performance. A PSA apparatus serves to separate air by the adsorption method. It does not permit the formation of pure oxygen, but makes it possible to prepare a gas containing oxygen in an amount of at least 90% at a low cost. This apparatus can be used effectively in this process. Even if the oxygen-containing gas from this PSA apparatus is used, the running cost of the gas diffusion cathode depends largely on the excess ratio of the oxygen-containing gas to be fed newly.

As an ordinarily employed electrolytic cell of an alkali chloride having a gas diffusion cathode, that having a filter press structure is usually used. It has a structure wherein a plurality of units each of which is formed of an anode chamber having an anode, an ion exchange membrane, a cathode chamber and a gas diffusion cathode (equipped with a gas chamber) in the order of mention have been stacked one after another. It is the common practice, upon supply of each of gas chambers with an oxygen-containing gas, to adopt one flow-rate control system for one electrolytic cell or a plurality of electrolytic cells and feed each gas chamber with a uniformly dispersed gas through a convenient system such as orifice, because adjustment of the flow rate of the oxygen-containing gas to be fed to each of the gas chambers leads to a cost increase. Flow rates differ to some extent with gas chambers. In order to prevent shortage in an amount of the oxygen-containing gas in each gas chamber, an excess ratio must be set greater, causing a waste of the raw material.

The electrolytic cell of an alkali chloride equipped with a gas diffusion cathode is usually a triple chamber type. Since the electrolytic cell of a triple chamber type has three chambers, that is, a cathode chamber, a catholyte chamber and a gas chamber partitioned by an ion exchange membrane and a liquid-impermeable gas diffusion cathode, it is called "triple chamber type".

A double chamber type using a liquid-permeable gas diffusion electrode is also under investigation. In this double chamber type, one unit is formed of an anode chamber having an anode, an ion exchange membrane, a gas diffusion cathode and a gas chamber also serving as a cathode chamber in the order of mention. In this double chamber type, the electrolytic cell has two chambers divided by the ion exchange membrane, that is, anode chamber and the gas chamber also serving as a cathode chamber.

Since the gas diffusion cathode of this electrolytic cell is liquid permeable, alkali metal ions which have passed through a cationic ion exchange membrane do not remain between the ion exchange membrane and gas diffusion cathode so that the gas diffusion cathode can be adhered closely with the ion exchange membrane without substantial formation of a cathode chamber, leading to a reduction in the distance between electrodes. An electric resistance however increases without an electrolytic solution between the ion exchange membrane and gas diffusion cathode so that a spacer having a high moisture content is disposed between them to keep an aqueous caustic alkali solution in the spacer, whereby electrolysis can be continued.

Also in the double chamber type, an oxygen-containing gas is fed to the gas chamber also serving as a cathode chamber which is disposed on the back side of the gas diffusion cathode. An oxygen gas is diffused in the gas diffusion cathode having excellent gas permeability and a caustic alkali is formed at the reaction point. The aqueous caustic alkali solution thus formed drops down in the spacer or taken out into the back side of the cathode through the pores thereof and is discharged outside the electrolytic cell together with an excessive oxygen-containing gas.

Control of the temperature of an electrolytic cell also poses a problem. An electrolytic cell of an alkali chloride is usually operated smoothly at 80 to 90° C. In the ion exchange membrane method using a conventional hydrogen-generating type cathode, a catholyte was circulated into an external thermal exchanger, at which it was heated or cooled and temperature adjustment was thus conducted. In the electrolysis of an alkali chloride in accordance with the ion exchange membrane method using a gas diffusion cathode, when the electrolytic cell is a triple chamber type, the temperature of the electrolytic cell can be adjusted by circulating the catholyte of the cathode chamber into an external heat exchanger, thereby heating or cooling the catholyte. In the double chamber type, on the other hand, it is almost impossible to return the catholyte into the electrolytic cell again. A new temperature controlling system is therefore required.

DISCLOSURE OF THE INVENTION

The invention relates to an electrolytic process for electrolyzing an aqueous alkali chloride solution, thereby preparing chlorine and a caustic alkali in an electrolytic cell of an alkali chloride equipped with a gas diffusion cathode. An object of the invention is to reduce an excess ratio of oxygen in a newly fed oxygen-containing gas and to facilitate temperature control of the electrolytic cell.

The present inventors have proceeded with an extensive investigation, in a process for electrolyzing an aqueous alkali chloride solution, thereby preparing chlorine and a caustic alkali in an alkali chloride electrolytic cell equipped with a gas diffusion cathode, with a view to reducing the amount of an oxygen-containing gas to be fed newly, in other words, reducing an excess ratio of oxygen in the oxygen-containing gas to be fed newly from the outside; and to facilitating temperature control of the electrolytic cell. As a result, they have succeeded in the completion of the invention.

The above-described objects can be attained by the invention, more specifically, by the below-described means.

1. A process for electrolyzing an alkali chloride comprising: introducing saline water into an anode chamber of an ion-exchange-membrane-method alkali chloride electrolytic cell equipped with a gas diffusion cathode; and introducing an oxygen-containing gas into a gas chamber of a gas diffusion cathode, to thereby obtain chlorine in the anode chamber and an aqueous caustic alkali solution in the cathode chamber, wherein a portion of the oxygen-containing gas which is discharged from the gas chamber is fed back to the gas chamber to carry out circulating feed.

2. The process for electrolyzing an alkali chloride according to the above-described item 1, further comprising controlling the temperature of the electrolytic cell by cooling or heating the oxygen-containing gas to be introduced into the gas chamber.

3. The process for electrolyzing an alkali chloride according to the above-described item 1, wherein an oxygen amount of the discharged oxygen-containing gas to be circulated and fed to the gas chamber ranges from at least 10% but less than 300% of the stoichiometric oxygen amount.

The invention will next be described more specifically. In ion-exchange-membrane-method alkali chloride electrolysis by using a gas diffusion cathode, the below-described reaction occurs at the gas diffusion cathode.

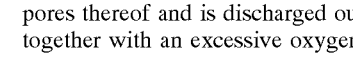

$$\tfrac{1}{4}O_2+\tfrac{1}{2}H_2O+e\rightarrow OH^-$$

In this manner, oxygen and water participate in the reaction at the gas diffusion cathode.

The invention will next be described in-detail based on accompanying drawings.

FIG. 2 illustrates one example of an ion-exchange-membrane-method electrolytic cell using a gas diffusion cathode which cell is an ordinarily employed triple chamber type.

Referring to FIG. 2, an anode chamber 2 has a similar structure to that of the ordinarily employed ion-exchange-membrane-method electrolytic cell. This chamber is fed with an aqueous alkali chloride solution from a feed opening 4. This solution is electrolyzed at a gas-liquid permeable anode 3. In this case, a porous plate or metal mesh type gas-liquid permeable anode which can allow a chorine gas emitted on the anode surface to escape to the back side is employed as the anode 3 in order to shorten the distance with the ion exchange membrane. The resulting chlorine gas and dilute aqueous solution of an alkali chloride are discharged from a discharge opening 5. Alkali metal ions generated at the anode 3 move to a cathode chamber 7, passing through an ion exchange membrane 6 (in the case of tripe chamber type, this cathode chamber may be called "caustic chamber" to distinguish it from a gas chamber also serving as a cathode chamber in the double chamber type). The cathode chamber 7 is fed with an aqueous caustic alkali solution or water from a feed opening 8 and at a gas diffusion cathode 10, electrolysis is effected in accordance with the above-described reaction scheme. Hydroxyl ions thus formed react with the alkali metal ions which have moved, passing through the ion exchange membrane 6 and form a caustic alkali. The concentrated aqueous solution of the caustic alkali is discharged from the discharge opening 9. Into a gas chamber 11 disposed opposite to the cathode chamber 7 relative to the gas diffusion cathode 10, an oxygen-containing gas is fed from a gas feed opening 13 and discharged from a discharge opening 12.

In this triple chamber type, there are two chambers, that is, cathode chamber 7 and gas chamber 11, on the side of the cathode relative to the ion exchange membrane 6. The cathode chamber 7 may be called "caustic chamber" and a combination thereof with the gas chamber 11 may be called "cathode chamber". Since the invention relates to an oxygen-containing gas to be fed to the gas chamber, the cathode chamber 7 is called "cathode chamber" based on its original meaning that it contains a catholyte.

In the triple chamber system, the cathode chamber 7 is fed with an aqueous caustic alkali solution or water, while the gas chamber 11 is fed with an oxygen-containing gas.

FIG. 3 illustrates one example of a double chamber system of a gas-diffusion-cathode-equipped ion-exchange-membrane-method electrolytic cell. In FIG. 3, a portion of the electrolytic cell from the ion exchange membrane to the anode chamber is similar to that of FIG. 2. A gas diffusion cathode 29 is disposed in contact with a cationic ion exchange membrane 26. A cathode chamber 22 also serves as a gas chamber. Water fed from a gas+water feed opening 28 is used for adjusting the concentration of a caustic alkali.

In this double chamber system, the cathode chamber 32 is used also as a gas chamber so that this chamber is fed with both water or an aqueous caustic alkali solution and an oxygen-containing gas.

Ion-exchange-membrane-method electrolysis by using a gas diffusion cathode has a variety of systems as described above, but the process of the invention can be applied to any system.

One example of the flow chart of the invention is shown in FIG. 1. An electrolytic cell 34 is a double-chamber type cell wherein a plurality of units each formed of an anode chamber 31 having an anode, an ion exchange membrane 33 and a cathode 32 having a gas diffusion cathode and also serving as a gas chamber are arranged. An aqueous alkali chloride solution is fed to the anode chamber 31, while an oxygen-containing gas and water are fed from a PSA apparatus 30 to the cathode chamber 32 also serving as a gas chamber. After an aqueous caustic alkali solution and oxygen-containing gas discharged from the cathode chamber 32 also serving as a gas chamber are separated at the gas-liquid separator 35, a portion of the discharged oxygen-containing gas is circulated to the cathode chamber 32 also serving as a gas chamber.

By circulating a portion of the discharged oxygen-containing gas as described above, an excess ratio of an oxygen amount in the cathode chamber 32 also serving as a gas chamber can be maintained high even if an excess ratio of an oxygen amount in an oxygen-containing gas to be fed newly from the PSA apparatus is low. In the operation of the gas diffusion cathode in the invention, not only an excess amount (excess ratio) of oxygen relative to the stoichiometric oxygen amount but also an excess amount (excess ratio) of oxygen in an oxygen-containing gas to be newly fed has a significant meaning. Both ratios can be suppressed in the invention.

The following example is presumed to promote our understanding of this. Supposing that a gas chamber is fed, from a PSA apparatus 30, with 100 liters (per hour, which will equally apply to the below-described example) of an oxygen containing gas having an oxygen concentration of 80% and at the gas diffusion electrode, 60 liters of oxygen is consumed, an excess ratio of oxygen supplied from a newly-fed oxygen-containing gas will be about 33%. The oxygen concentration of the discharged oxygen-containing gas at this time is 50% and the amount of the gas is 40 liters (including 20 liters of oxygen remained after consumption and 20 liters of an inactive gas such as nitrogen).

If an oxygen amount from the portion of the oxygen-containing gas discharged and circulated to the gas chamber is 14 liters, an amount of oxygen fed to the gas diffusion cathode can be kept at 80 liters even if the oxygen amount from the newly fed oxygen-containing gas is reduced to 66 liters. In this case, the oxygen concentration of the newly fed oxygen-containing gas is 80%, which makes it possible to newly feed only 82.5 liters of an oxygen-containing gas. This means an excess ratio of oxygen in the newly fed oxygen-containing gas becomes 10% (in this case, the oxygen concentration of a mixture of the newly-fed oxygen-containing gas and discharged and circulated oxygen-containing gas becomes lower than 80%, but the oxygen consumption amount at the gas diffusion electrode is still maintained at 60 liters).

A reduction of an excess ratio of oxygen in a newly fed oxygen-containing gas from 33% to 10% according to the invention decreases the feed amount of a newly-fed oxygen-containing gas even by 17.5%, which brings about marked effects for cost reduction.

A rise in a circulation amount of the discharged oxygen-containing gas is advantageous for a cost reduction, but it reduces the oxygen concentration of an oxygen mixture composed of the newly-fed oxygen-containing gas and discharged oxygen-containing gas to be fed to the gas chamber, leading to lowering in the performance of the gas diffusion electrode. In practice, there is limitation on the amount of the discharged oxygen-containing gas to be circulated. In addition, a cost increase due to an increase in a blast amount for circulation of the discharged oxygen-containing gas must be considered.

In the invention, the oxygen amount in the discharged oxygen-containing gas to be circulated and fed to the gas chamber is preferably set at 10% or greater but less than 300% of the stoichiometric oxygen amount required. Upon determination of the amount, however, the above-described conditions are also taken into consideration.

The oxygen excess ratio of an oxygen-containing gas must be set to fall within a range of from 30 to 50% in the conventional process wherein only a newly-fed oxygen-containing gas is introduced into a gas diffusion cathode as an oxygen-containing gas. According to the invention, on the other hand, an oxygen excess ratio of a newly fed oxygen-containing gas can be reduced to 10 to 30%.

As illustrated in FIG. 3, a thermal exchanger 37 is disposed in an oxygen gas feed line and by heating or cooling through this heat exchanger, the temperature of an electrolytic cell is controlled. In general, heating is necessary when an electrolytic current is low and cooling is necessary when an electrolytic current is high. Since the discharged oxygen-containing gas is fed after circulation, an amount of the oxygen-containing gas to be fed to the electrolytic cell is maintained large, which facilitates heating or heat removal (cooling) for the temperature control of the electrolytic cell.

In ion-exchange-membrane-method electrolysis using a gas diffusion electrode according to the invention, a portion of the discharged oxygen-containing gas is circulated and fed to the gas chamber of the gas diffusion cathode so that an excess ratio of oxygen in an oxygen-containing gas can be maintained small, and the temperature of the electrolytic cell can be controlled easily. It should be noted that the term "gas chamber of the gas diffusion cathode" embraces "the gas diffusion cathode also serving as a gas chamber".

BEST MODE FOR CARRYING OUT THE INVENTION

Figure 1:
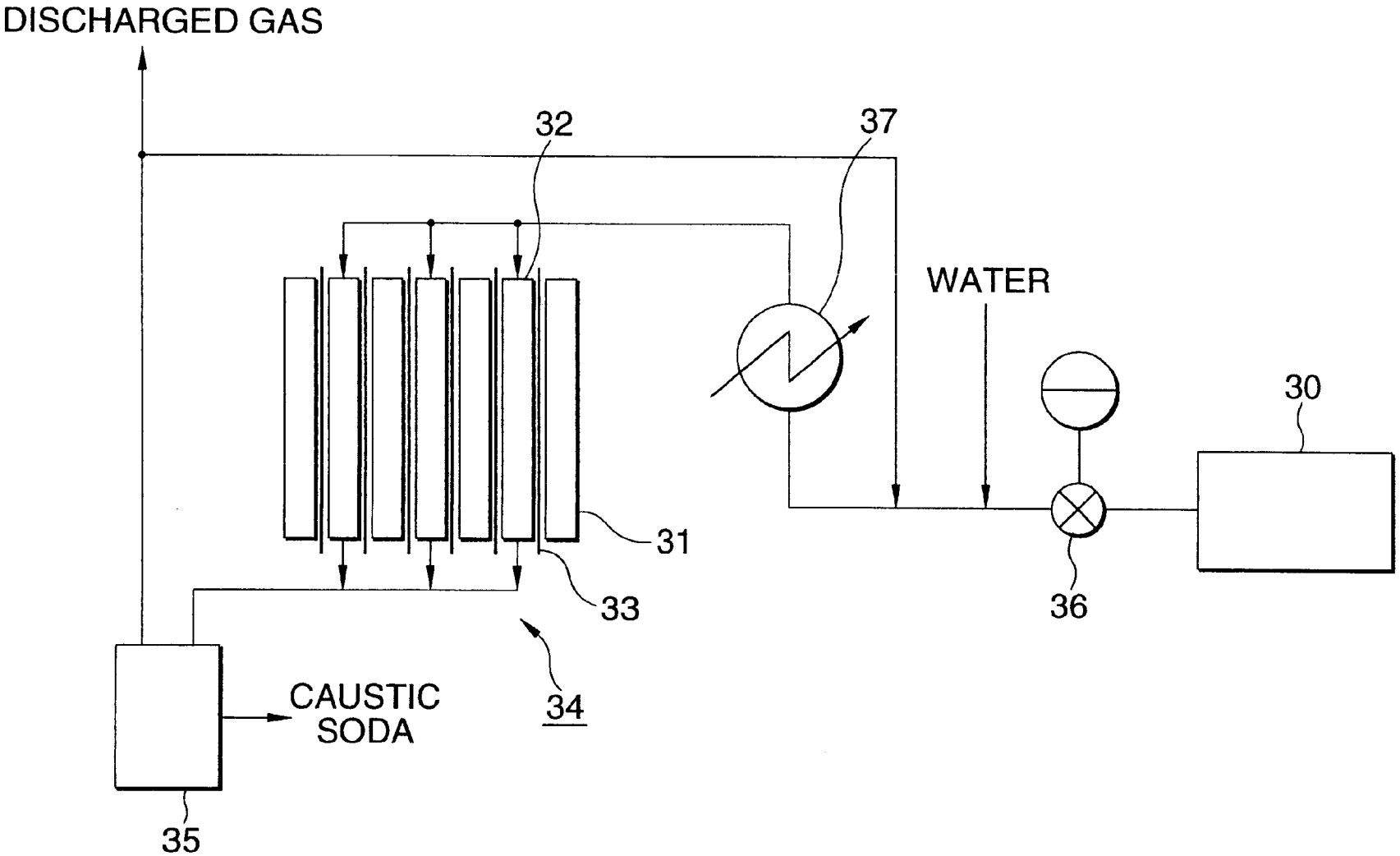
FIG. 1 is a flow chart of electrolysis of an alkali chloride according to the invention.
Figure 2:
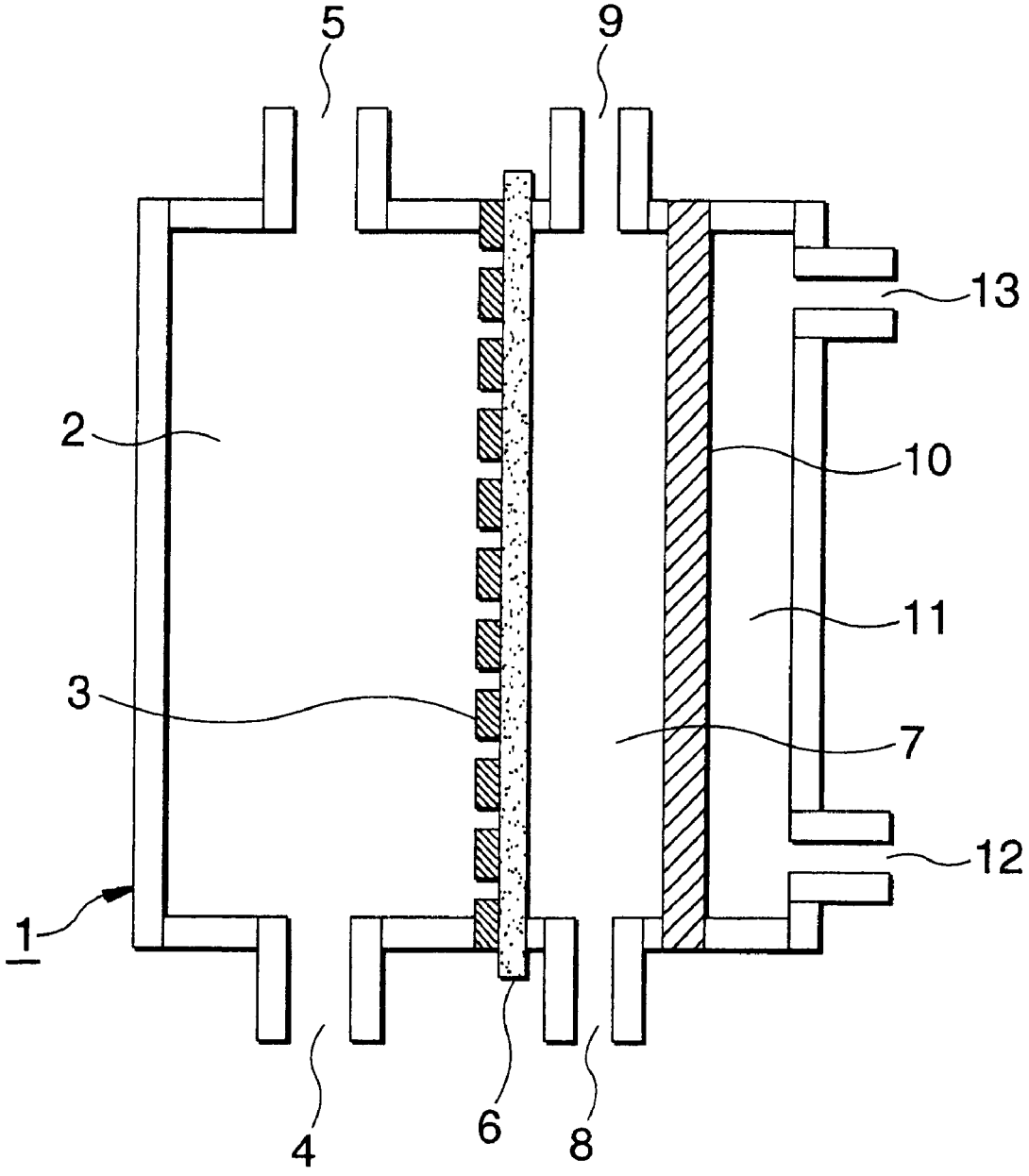
FIG. 2 is a schematic view illustrating a triple-chamber-type ion-exchange-membrane-method electrolytic cell equipped with a gas diffusion cathode.
Figure 3:
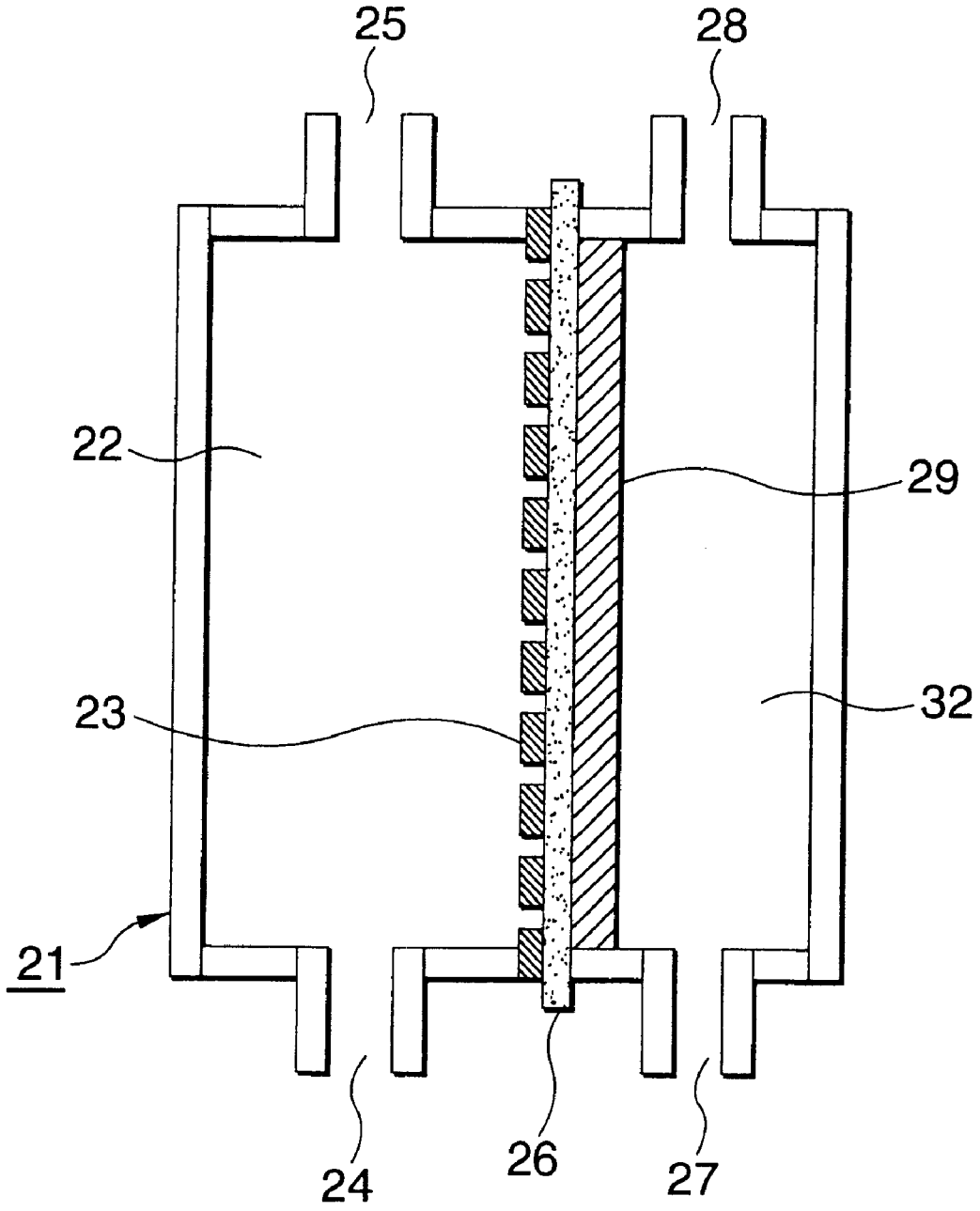
FIG. 3 is a schematic view illustrating a double-chamber-type ion-exchange-membrane-method electrolysis equipped with a gas diffusion cathode.

The invention will hereinafter be described in detail by reference to examples, but the invention should not be construed as being limited thereto

EXAMPLE 1

1. Electrolytic Cell and Electrolysis Conditions

Electrolysis test was conducted under the below-described conditions by using a single-pole type electrolytic cell (modification of "Electrolytic cell DCM 102", product of Chlorine Engineers Co., Ltd.) formed of two anode chambers having an anode, two cathode chambers having a gas diffusion cathode and two gas chambers.

Area of electrode: 75.6 $dm^2$ (62 cm wide×122 cm)×2

Current density: 30 $A/dm^2$

Cathode: an electrode obtained by applying a substance composed mainly of $RuO_2/TiO_2$ to a base material of titanium; "DSE", trade mark; product of Permelec Electrode Ltd.

Ion exchange membrane: "F4203", product of Asahi Chemical Industry Co., Ltd.

Gas diffusion cathode: obtained by integrally forming, by hot press, a gas diffusion layer composed of 60% of hydrophobic carbon black ("Acetylene Black", product of Denki Kagaku Kogyo Kabushiki Kaisha) and 40% of PTFE ("D-1" product of Daikin Industries Ltd), a reaction layer composed of 20 parts of hydrophilic carbon black ("AB-12", product of Denki Kagaku Kogyo Kabushiki Kaisha) and 10 parts of PTFE, and silver mesh as a current collecting material and having 3 $mg/cm^2$ of silver born on the gas diffusion cathode as a catalyst.

Span between electrodes: anode/ion exchange membrane=0 mm, ion exchange membrane/cathode=3.5 mm Concentration of caustic soda in the cathode chamber: 32%

Amount of caustic soda to be circulated: 400 liters/hour

Concentration of an aqueous sodium chloride solution to be fed: 300 g/liter

Concentration of an aqueous sodium chloride solution in anode chamber: 200 g/liter.

Concentration of oxygen in a feed gas: 93% (fed from a PSA apparatus)

2. Electrolysis Test (1) Test 1

The amount of an oxygen-containing gas (oxygen concentration: 93%) fed from the PSA apparatus was 1.3 $m^3/hr$ and an excess ratio of oxygen was 19% (this excess ratio of oxygen means that of a newly-fed oxygen-containing gas). Measurement of the oxygen concentration in the discharged oxygen-containing gas in two gas chambers resulted in 74% and 54%, respectively. As a result of calculation based on these values, the excess ratios of oxygen in these gas chambers were found to be 28% and 10%, respectively (each, an excess ratio of the oxygen feed relative to the stoichiometric oxygen amount). The electrolytic voltage at this time was 2.24V.

(2) Test 2

While maintaining the feed rate of the oxygen-containing gas from PSA at 1.3 m /hr, the discharged oxygen-containing gas was returned to a feed line at 0.15 $m^3/hr$, resulting in that the oxygen concentrations in the discharged gas in two gas chambers were 72% an 62%, respectively. Based on them, the excess ratios of oxygen in these gas chambers were calculated, showing an increase to 37% to 21%, respectively (each, an excess ratio of the oxygen feed relative to the stoichiometric amount of oxygen). The electrolytic voltage at this time was 2.32V.

Test 2 shows that by the circulation of the discharged oxygen-containing gas, an excess ratio of oxygen in the gas chamber can be made higher than that of Test 1.

(3) Test 3

Without changing the conditions except that the feed rate of an oxygen-containing gas from PSA was decreased gradually to 1.2 $m^3/hr$, an excess ratio of oxygen was decreased to 10% (this excess ratio of oxygen means that of a newly-fed oxygen-containing gas). Measurement of the oxygen concentration in the discharged oxygen-containing gas in two gas chambers resulted in 61% and 41%, respectively. As a result of calculation based on these values, the excess ratios of oxygen in these gas chambers were found to be 25% and 10%, respectively (each, an excess ratio of the oxygen feed relative to the stoichiometric oxygen amount). The electrolytic voltage at this time was 2.24V.

Test 3 shows that similar to Test 2, an excess ratio of oxygen in the gas chamber can be maintained at a level not disturbing electrolysis owing to the circulation of the discharged oxygen-containing gas.

(3) Test 4

The temperature of the oxygen-containing gas during feeding was increased from room temperature to 80° C. by heating through a heat exchanger disposed in an oxygen-containing gas feed line, resulting in an increase in the temperature of the electrolytic cell to 81 to 83° C. The electrolytic voltage became 2.21 V.

INDUSTRIAL APPLICABILITY

According to the invention, in an electrolytic cell of an alkali chloride equipped with a gas diffusion cathode, an excess ratio of oxygen in the gas chamber of a gas diffusion cathode can be maintained high even after reduction in an excess ratio of oxygen in an oxygen-containing gas to be fed newly from outside, which makes it possible to decrease the amount of the newly-fed oxygen-gas containing gas, thereby markedly reducing the cost of electrolysis.

In addition, the temperature of the electrolytic cell can be controlled easily by the adjustment of the temperature of the oxygen-containing gas to be fed to the gas chamber of the gas diffusion cathode.

What is claimed is:

1. A process for electrolyzing an alkali chloride comprising:

introducing saline water into an anode chamber of an ion-exchange-membrane-method alkali chloride electrolytic cell equipped with a gas diffusion cathode;

introducing an oxygen-containing gas into a gas chamber of a gas diffusion cathode to obtain chlorine in the anode chamber and an aqueous caustic alkali solution in the cathode chamber, wherein a portion of the oxygen-containing gas which is discharged from the gas chamber is fed back to the gas chamber to carry out circulating feed; and controlling the temperature of the electrolytic cell by cooling or heating the oxygen-containing gas to be introduced into the gas chamber.

2. A process for electrolyzing an alkali chloride comprising:

introducing saline water into an anode chamber of an ion-exchange-membrane-method alkali chloride electrolytic cell equipped with a gas diffusion cathode; and introducing an oxygen-containing gas into a gas chamber of a gas diffusion cathode to obtain chlorine in the anode chamber and an aqueous caustic alkali solution in the cathode chamber, wherein a portion of the oxygen-containing gas which is discharged from the gas chamber is fed back to the gas chamber to carry out circulating feed, wherein an oxygen amount of the discharged oxygen-containing gas to be circulated and fed to the gas chamber ranges from at least 10% but less than 300% of the stoichiometric oxygen amount.

3. The process of claim 2, further comprising the step of controlling the temperature of the electrolytic cell by cooling or heating the oxygen-containing gas to be introduced into the gas chamber.

* * * * *